US006161303A

United States Patent [19]

Beck

[11] Patent Number: 6,161,303

[45] Date of Patent: Dec. 19, 2000

[54] PRESSING APPARATUS HAVING CHAMBER END SEALING

[75] Inventor: David A. Beck, Appleton, Wis.

[73] Assignee: Voith Sulzer Papiertechnik Patent GmbH, Heidenheim, Germany

[21] Appl. No.: 09/408,691

[22] Filed: Sep. 30, 1999

Related U.S. Application Data

[60] Provisional application No. 60/106,169, Oct. 29, 1998, provisional application No. 60/106,647, Nov. 2, 1998, and provisional application No. 60/106,649, Nov. 2, 1998.

[51] Int. Cl.[7] ..... D06F 58/00

[52] U.S. Cl. ..... 34/119; 34/121; 34/124; 34/601; 34/146; 34/242; 492/46

[58] Field of Search ..... 34/115, 117, 119, 34/121, 124, 601, 146, 242; 100/47, 118, 162 B, 170; 162/290, 375; 384/276, 278, 279; 277/130, 131, 132; 492/7, 16, 46, 47, 535

[56] References Cited

U.S. PATENT DOCUMENTS

| | | | |
|---|---|---|---|
| 3,808,096 | 4/1974 | Busker et al. | 162/358 |
| 4,124,942 | 11/1978 | Ohis et al. | 34/115 |
| 4,172,910 | 10/1979 | Rotar | 427/243 |
| 4,173,249 | 11/1979 | Holkko et al. | 162/360 R |
| 4,559,106 | 12/1985 | Skytta et al. | 162/358 |
| 4,675,079 | 6/1987 | Webster | 162/360.1 |
| 4,888,096 | 12/1989 | Cowan et al. | 162/35 R |
| 4,995,147 | 2/1991 | Ahrweiler et al. | 29/116.1 |
| 5,010,633 | 4/1991 | Brown et al. | 29/113.2 |
| 5,163,236 | 11/1992 | Heikkila | 34/115 |
| 5,274,930 | 1/1994 | Ensign et al. | 34/23 |
| 5,291,666 | 3/1994 | Babinsky et al. | 34/117 X |
| 5,584,126 | 12/1996 | Ensign et al. | 34/444 |
| 5,625,961 | 5/1997 | Ensign et al. | 34/117 |
| 5,700,356 | 12/1997 | Lefkowitz | 162/358.1 |
| 5,810,974 | 9/1998 | Laapotti | 492/46 X |
| 5,900,120 | 5/1999 | Graf | 162/290 |
| 5,967,958 | 10/1999 | Borkenhagen et al. | 492/46 |
| 6,039,681 | 3/2000 | Heinz-Michael | 492/46 X |

FOREIGN PATENT DOCUMENTS

| | | | |
|---|---|---|---|
| 141 560 | 10/1986 | Poland | D21F 9/02 |
| 1599347 | 9/1981 | United Kingdom | D21F 3/04 |
| WO 99/23296 | 5/1999 | WIPO | D21F 1/48 |
| WO 99/23301 | 5/1999 | WIPO | D21F 11/14 |

OTHER PUBLICATIONS

TAPPI, Characterization of Wet Felts, TIP 0404–20, 1976, pp. 1–3.

Joseph R. Pounder, Elementary Mathematical Models of Displacement Pressing, TAPPI Journal, Feb., 1987, pp. 97–100.

Wlodzimierz Kawka and Edward Szwarcsztajn, Some Results of Investigations on the Equipment for Intensive Dewatering and Drying of Porous Papers, Technical University of Lodz/Poland, Paper No. 31, pp. 153–169.

Thomas Pfuff and Werner Stahl, Dewatering by Mechanical Compression Followed by Application of Differential Gas Pressure, Chemie–Ingenieur–Technik 64, No. 3, 1992, pp. 298–299.

Jeffrey D. Lindsay, Displacement Dewatering to Maintain Bulk, Helsinki Symposium on Alternate Methods of Pulp and Paper Drying, Helsinki, 1991.

*Primary Examiner*—Stephen Gravini
*Attorney, Agent, or Firm*—Taylor & Aust, P.C.

[57] ABSTRACT

An apparatus for processing a continuous web includes a plurality of rollers arranged for cooperative rotation. Each of the plurality of rollers have a first circular end surface, a second circular end surface and a cylindrical middle surface. The plurality of rollers define a corresponding plurality of nips. First and second sealing panels are provided for engaging the first and second circular ends of each of the plurality of rollers. The first and second sealing panels and the plurality of rollers define a chamber. The first and second sealing panels are structured and adapted to conform generally to the shape of the first and second circular end surfaces, respectively, of the plurality of rollers. End panel sealing of the chamber is provided by mechanical sealing, fluid sealing, or a combination thereof.

23 Claims, 7 Drawing Sheets

PRESSING APPARATUS HAVING CHAMBER END SEALING

This application claim benefit to application 60/106,169 filing date Oct. 29, 1998 which this application claim benefit to application 60/106,647 filing date Nov. 2, 1998 which this application claim benefit to application 60/106,649 filing date Nov. 2, 1998.

BACKGROUND OF THE INVENTION

1. Field of the Invention

The present invention relates to a pressing apparatus, and more particularly, to a pressing apparatus having a plurality of rollers forming a chamber.

2. Description of the Related Art

For many years attempts have been made to use external air pressure to force water out of a paper web. Rather than compress a sheet at a press nip to the point where hydraulic pressure drives water out, as is the case in normal wet pressing, it was reasoned that more water could be removed, and sheet bulk could be maintained, if air pressure could be applied to supplement roller nip generated hydraulic pressures. One such attempt involves providing a multi-roller structure forming a closed chamber, wherein air is circulated through the chamber to convect moisture out of the paper web. Providing efficient sealing of such a chamber, and in particular providing chamber end sealing for the rollers, has proven to be problematic due to the relatively large rotary contact surfaces which must be effectively sealed.

Accordingly, a need exists for an improved pressing apparatus which provides efficient sealing of a chamber, and in particular, provides efficient end sealing between the roller ends and the chamber end panels.

SUMMARY OF THE INVENTION

The present invention provides a pressing apparatus which provides efficient sealing of a chamber, and in particular, provides efficient end sealing between the roller ends and the chamber end panels.

One aspect of the invention is an apparatus for processing a continuous web, including a plurality of rollers arranged for cooperative rotation. Each of the plurality of rollers have a first circular end surface, a second circular end surface and a cylindrical middle surface. The plurality of rollers define a corresponding plurality of nips. First and second sealing panels are provided for engaging the first and second circular ends of each of the plurality of rollers. The first and second sealing panels and the plurality of rollers define a chamber. The first and second sealing panels are structured and adapted to conform generally to the shape of the first and second circular end surfaces, respectively, of the plurality of rollers.

In another aspect of the invention, an apparatus for processing a continuous web includes the plurality of rollers arranged for cooperative rotation, wherein each of the plurality of rollers has a first circular end surface, a second circular end surface and a cylindrical middle surface. The plurality of rollers define a corresponding plurality of nips. A first sealing panel and a second sealing panel engage the first and second circular ends of each of the plurality of rollers. The first and second sealing panels and the plurality of rollers define a chamber. A fluid seal is formed between at least one of the first circular end of each of the plurality of rollers and the first sealing panel, and the second circular end of each of the plurality of rollers and the second sealing panel.

In still another aspect of the invention, an apparatus for processing a continuous web includes a plurality of rollers arranged for cooperative rotation, wherein each of the plurality of rollers have a first circular end surface, a second circular end surface and a cylindrical middle surface. The plurality of rollers define a corresponding plurality of nips. First and second sealing panels are provided for engaging the first and second circular ends of each of the plurality of rollers. The first and second sealing panels and the plurality of rollers define a chamber. At least one of the first and second end panels include an end cavity defining an inner perimetrical surface extending outwardly from an inner end surface. Further provided is at least one unitary seal including a base, a first side wall and a second side wall, and having a substantially U-shaped cross-section. The base of the at least one unitary seal contacts the inner perimetrical surface of the cavity, respectively, and defines a closed portion of the substantially U-shaped cross-section. The first side wall of the at least one unitary seal contacts the inner end surface of the cavity, and the second side wall of the at least one unitary seal contacts at least a portion of one of the first circular end surface of each of the plurality of rollers and the second circular end surface of each of the plurality of rollers.

An advantage of the present invention is that the end seal arrangements provide effective sealing between the circular ends of the roller assembly and the sealing panels of the pressing apparatus.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrates preferred embodiments of the invention, and such exemplifications are not to be construed as limiting the scope of the invention in any manner.

DETAILED DESCRIPTION OF THE INVENTION

Figure 1:
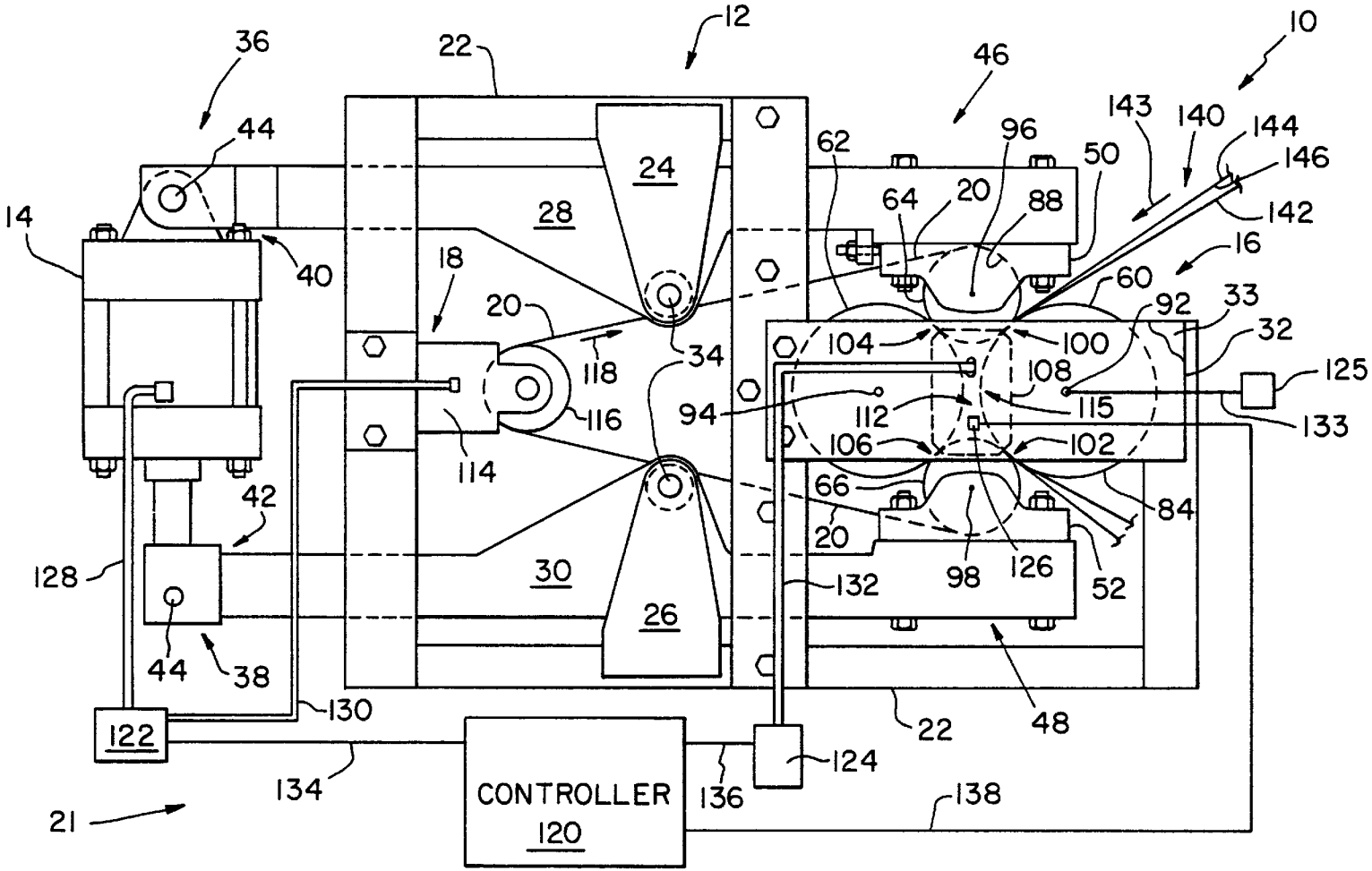
FIG. 1 is a partially schematic side view of an embodiment of the present invention.

Referring now to the drawings and particularly to FIG. 1, there is shown a press arrangement 10 which is particularly useful in paper making. Press arrangement 10 includes a frame 12, a loading cylinder 14, a press roller assembly 16, a tensioning assembly 18, a membrane 20 and a control unit 21.

Frame 12 includes a main frame 22, an upper pivot frame 24, a lower pivot frame 26, an upper pivot arm 28, a lower pivot arm 30 and a pair of side frames 32, 33. Side frame 32 is shown with a portion broken away to expose an interior portion of side frame 33. Pivot frames 24, 26 are fixedly attached, such as by welds or bolts, to main frame 22. Pivot arms 28, 30 are pivotally mounted to pivot frames 24, 26, respectively, by a plurality of pivot pins 34 in a conventional manner. Each of the pivot arms 28, 30 have a first end 36, 38, respectively, adapted to mount opposing ends 40, 42 of loading cylinder 14 via pins 44. Each of the pivot arms 28, 30 has a second end 46, 48, adapted to fixedly mount, such as by welds or bolts, bearing housings 50, 52, respectively. First and second side frames 32, 33 are mounted to opposing sides of main frame 22.

Pressing roller assembly 16 includes a plurality rollers 60, 62, 64, 66 (four rollers as shown) arranged for cooperative rotation in frame 12. By cooperative rotation, it is meant that a rotational velocity at the circumferential surface of each of the rollers 60, 62, 64, 66 together are substantially equal, with essentially no slippage between the roller surfaces. For convenience, sometimes rollers 60, 62 will be referred to as main rollers and rollers 64, 66 will be referred to as cap rollers.

Figure 2:
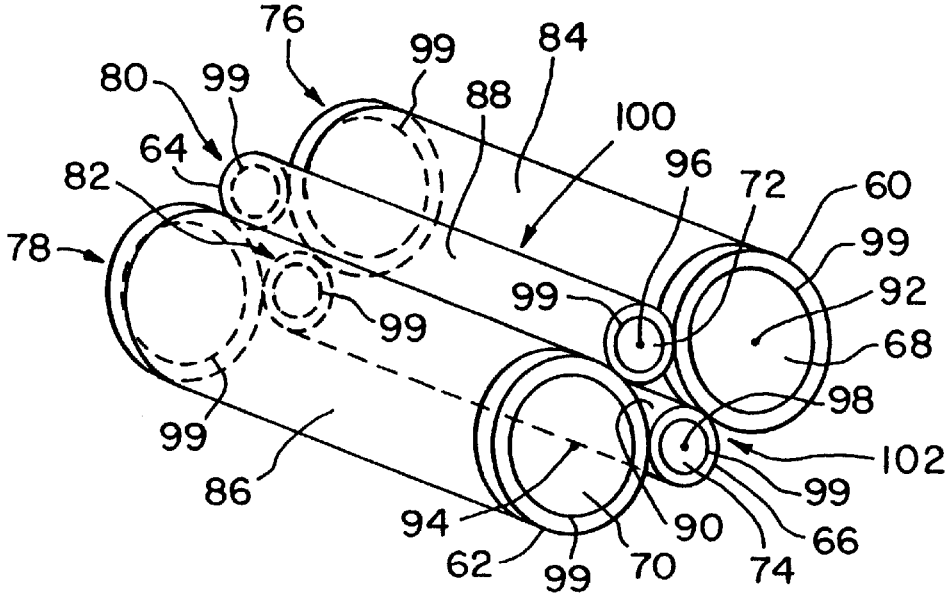
FIG. 2 is perspective side view of the roller configuration of the embodiment of FIG. 1.
Figure 3:
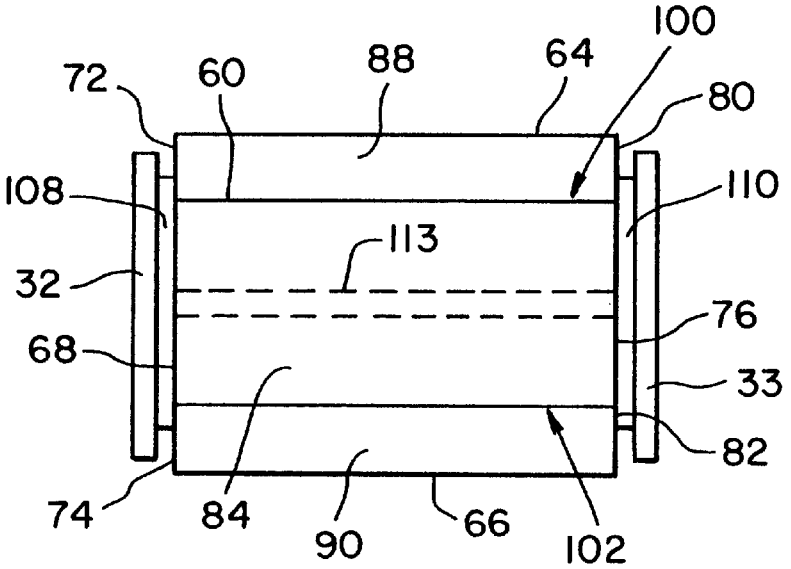
FIG. 3 is a partial front view of the roller configuration of the embodiment of FIG. 1.

As shown in FIGS. 2 and 3, generally, each of the rollers 60, 62, 64, 66 are closed hollow cylinders having a first circular end 68, 70, 72, 74, respectively, a second circular end 76, 78, 80, 82, respectively, and a cylindrical middle circumferential surface 84, 86, 88, 90, all being radially symmetrical about an axis of rotation 92, 94, 96, 98, respectively. A set of seals 99 may be attached to first circular ends 68, 70, 72, 74 and second circular ends 76, 78, 80, 82. An axial extent of each of the main rollers 60, 62 and cap rollers 64, 66 together are arranged in parallel. Preferably, a circumference of either of cap rollers 64, 66 is smaller than a circumference of either of main rollers 60, 62. As shown in FIG. 1, the rollers 60, 62, 64, 66 are positioned to define a corresponding number of roller nips 100, 102, 104, 106.

Cap rollers 64, 66 are used to create a seal along the axial extent of main rollers 60, 62 at roller nips 100, 102, 104, 106. Each of rollers 60, 62, 64, 66 may include an elastic coating, such as rubber, to aid in sealing at the roller nips. Sealing at roller nips 100, 102, 104, 106 requires relatively uniform pressure along all roller nips 100, 102, 104, 106. With the likely deflection of main rollers 60,62, due to the exertion of force thereon by cap rollers 64, 66, some mechanism is needed to aid in providing uniform nip pressure at roller nips 100, 102, 104, 106. Accordingly, cap rollers 64, 66 can use hydraulic pressure and a series of pistons within the roller shell of rollers 64, 66 to press the roller shell of rollers 64, 66 into the roller shell of main rollers 60, 62 to provide uniform pressure at the associated nips. Alternatively, a crowned cap roller could be used.

As shown in FIG. 3, first and second side frames 32, 33 include first and second sealing panels 108, 110 respectively, mounted to an interior side thereof. First and second sealing panels 108, 110 are forced by side frames 32, 33 to engage a portion of first circular ends 68, 70, 72, 74 and a portion of second circular ends 76, 78, 80, 82 respectively, of rollers 60, 62, 64, 66 of pressing roller assembly 16 to define a chamber 112, and to effect end sealing of chamber 112. Optionally, at least one tension bar 113 is connected between first sealing panel 108 and second sealing panel 110 in chamber 112. In some embodiments, first and second sealing panels 108, 110 are flexible and are structured and adapted to substantially conform to the shape of first circular ends 68, 70, 72, 74 and second circular ends 76, 78, 80, 82, respectively, of rollers 60, 62, 64, 66. To further aid in the sealing of chamber 112, seals are formed between first and second sealing panels 108, 110 and first and second circular ends 68, 70, 72, 74 and 76, 78, 80, 82, respectively. Such seals can include mechanical seals and fluid seals.

Main rollers 60, 62 are fixedly rotatably mounted to side frames 32, 33 using conventional bearing mounting assemblies, such as those containing roller bearings or bushings. In this context, fixedly rotatably mounted means that the axes 92, 94 of rollers 60, 62 are not shifted in location with respect to main frame 22 and side frames 32, 33 following installation, but rotation about axes 92, 94 is permitted.

Preferably, main roller 60, which fluidly communicates with chamber 112 via membrane 20, includes at least one void in the form of a groove, a hole and a pore formed in its middle circumferential surface to facilitate a pressure differential across membrane 20 and any intervening material, such as continuous web 140. Also, it is preferred that main roller 62, which does not fluidly communicate with chamber 112 via membrane 20, not include any such void in its middle circumferential surface. Each of the rollers may include an elastic coating, such as rubber over all or part of their roller surface, to aid in the sealing of chamber 112 at roller nips 100, 102, 104, 106.

Cap rollers 64, 66 are rotatably mounted to bearing housings 50, 52, respectively. However, the axes of rotation 96, 98 of rollers 64, 66 are moveable with respect to main frame 22 via pivot arms 28, 30, respectively, to effect a loading of press roller assembly 16. Since a circumference, and a corresponding diameter, of either of cap rollers 64, 66 is preferably smaller than a circumference, and a corresponding diameter, of either of main rollers 60, 62, the forces generated on cap rollers 64, 66 are reduced, thus allowing smaller structures to contain the forces within chamber 112.

For example, cap rollers 64, 66, being relatively smaller, require lower actuating force than would a relatively larger counterpart cap roller. If the diameters of cap rollers 64, 66 are one-third the diameters of main rollers 60, 62, the forces exerted on cap rollers 64, 66 can be reduced by 40 percent compared to the forces on main rollers 60, 62.

In general, the closer the distance between main rollers 60 and 62, and the greater the difference in diameters between main rollers 60, 62 and cap rollers 64,66, the greater the difference in forces exerted on frame 12 by main rollers 60, 62 and cap rollers 64,66. This arrangement allows the support structure, e.g. frame 12, for press roller assembly 16 to become simpler. For example, with most of the force exerted by the relatively larger main rollers 60,62, main rollers 60,62 are mounted on bearings fixedly attached to side frames 32,33, which in turn are fixedly attached to main frame 22. By structurally tying main rollers 60 and 62 together, and fixing their relative positions, the major forces within the press arrangement 10 are contained within a relatively simple mechanical structure.

In order to maintain membrane 20 at a proper operating tension, tensioning assembly 18 is mounted to main frame 22. Tensioning assembly 18 includes a tension cylinder 114 and a tension roller 116. Tension roller 116 is rotatably coupled to tension cylinder 114, which moves tension roller 116 in a direction transverse to an axis of rotation of tension roller 116.

As shown in FIG. 1 in relation to FIG. 2, membrane 20 travels in the direction of arrow 118 and is routed over a portion of circumferential surface 88 of cap roller 64, passes into inlet roller nip 100, passes over a portion of circumferential surface 84 of main roller 60 within chamber 112, passes out of outlet roller nip 102, passes over a portion of circumferential surface 90 of cap roller 66, and passes around about half of the circumferential surface of tension roller 116. Preferably, membrane 20 is a continuous belt made of a semipermeable material structured and adapted to have a predetermined permeability which permits a predetermined fluid flow therethrough. Also, preferably semipermeable membrane 20 is both gas permeable and liquid permeable to a limited degree. Furthermore, membrane 20 is structured and adapted to aid in the sealing of chamber 112 at inlet nip 100 and outlet nip 102. In chamber 112, after being pressurized, the combined effect of inlet nip 100, membrane 20 passing circumferentially around main roller 60, and outlet nip 102 is to effectively form a single expanded nip 115 for applying a mechanical pressing force on main roller 60 and any intervening material placed between membrane 20 and main roller 60. Thus, membrane 20 communicates with pressurized chamber 112 and main roller 60 to simultaneously effect both a predetermined fluid flow through and a mechanical pressing force on the intervening material.

In preferred embodiments, membrane 20 is made of a rubberized fabric about 0.1 inches thick, or less, and is made semipermeable by forming a plurality of holes 117 (see FIG. 6) through the fabric having a size, shape, frequency and/or pattern selected to provide the desired permeability. Preferably, the plurality of holes are formed by a laser. The permeability is selected to be greater than zero and less than about five CFM per square foot as measured by TAPPI test method TIP 0404-20, and more preferably, is selected to be greater than zero and less than about two CFM per square foot. Thus, semipermeable membrane 20 is both gas permeable and liquid permeable to a limited degree.

Control unit 21 includes a controller 120, a pneumatic source 122, a fluid source 124, a differential pressure source 125 and a sensor assembly 126.

Preferably, controller 120 includes a microprocessor and memory for storing and executing a control program, and includes an I/O device for establishing input/output communications and data transfer with external devices. Controller 120 can be, for example, an industrial programmable controller of a type which is well known in the art.

Pneumatic source 122 includes a plurality of individually controllable outputs. Pneumatic source 122 is fluidly coupled to loading cylinder 14 via conduit 128. Pneumatic source 122 is also fluidly coupled to tension cylinder 114 via conduit 130. While the preferred working fluid to operate cylinders 14, 114 is compressed air, those skilled in the art will recognize that the pneumatic system could be converted to another fluid source using another gas, or a liquid working fluid.

Fluid source 124 is fluidly coupled to chamber 112 via conduit 132. The type of fluid is selectable by the user depending the type of material that press arrangement 10 is processing. For example, in some applications, it may be desirable to use compressed dry air to pressurize chamber 112 to a predefined pressure, which in preferred embodiments of the invention, is a pressure greater than 30 p.s.i. above pressure the differential pressure of differential pressure source 125. In other applications, it may be desirable to use a pressurized gas, such as a healed gas, or a liquid, such as water, or a liquid solution.

In the embodiment of FIG. 1, fluid flows into chamber 112 via conduit 132 and flows out of chamber 112 via the voids, e.g. grooves, holes or pores, formed in middle circumferential surface 84 of main roller 60. The voids in main roller 60 communicate with differential pressure source 125 via a conduit 133. Differential pressure source 125 can be, for example, a vacuum source, a pressure source operating at a pressure lower than the pressure in chamber 112, or simply a vent to the atmosphere, which is coupled via conduit 133 to the interior of roller 60 to effect evacuation of the voids.

Alternatively, no venting via conduit 133 may be required if main roller 60 includes grooved voids, and the grooves communicate with atmospheric pressure. Similarly, venting via conduit 133 may be eliminated if the roller voids, such as blind holes, are large enough, and if they enter into the nip at a pressure lower than chamber pressure. In this case, the voids will act like a differential pressure source until the voids reach the chamber pressure. The void size can be selected to control the efficiency of the de-watering process.

The pressurized chamber 112 includes an inherent pressure relief, in that excessive pressure buildup in chamber 112 will result in one or more of rollers 60, 62, 64, 66 opening to bleed off the pressure, rather than undergoing catastrophic failure.

Controller 120 is electrically connected to pneumatic source 122 via electrical cable 134 to selectively control the fluid output thereof to independently control the operation of loading cylinder 14 to provide loading to press roller assembly 16 and to independently control the operation of tension cylinder 114 to provide a predetermined tension on semipermeable membrane 20.

Controller 120 is electrically connected to fluid source 124 via electrical cable 136. Controller 120 is further electrically connected to sensor assembly 126 via electrical cable 138. Sensor assembly 126 includes one or more sensing mechanisms to provide to controller 120 electrical feedback signals representing one or any combination of a pressure, a temperature or other environmental factor within chamber 112. Controller 120 processes the feedback signals to generate output signals which are supplied to fluid source 124 to selectively control the fluid output thereof.

In operation, controller 120 processes feedback signals received from sensor assembly 126 to control a pressure of pressurized chamber 112, preferably to a pressure greater than 30 p.s.i. above the pressure of differential pressure source 125. Rollers 60, 62, 64, 66 are rotated with little or no slip between them, and membrane 20 is driven at the same velocity as the surface velocity of rollers 60, 62, 64, 66. A continuous web, or paper web, 140 and a web carrying layer 142 are started into inlet roller nip 100 in the direction of arrow 143 and is guided by membrane 20 through expanded nip 115 to outlet roller nip 102. Membrane 20 is positioned within roller assembly 16 to be adjacent a first side 144 of continuous web 140 to effectively separate continuous web 140 from direct communication with pressurized chamber 112. In other words, the fluid in chamber 112 cannot act on continuous web 140 except through membrane 20. Web carrying layer 142 is positioned to contact cylindrical middle surface 84 of main roller 60 and to contact a second side 146 of continuous web 140.

Membrane 20 is structured and adapted to have a permeability which permits a predetermined fluid flow therethrough to continuous web 140, and communicates with pressurized chamber 112 and at least one void of main roller 60 to generate a pressure difference across membrane 20 and continuous web 140. This pressure drop results in a mechanical pressing force being applied to continuous web 140, which helps to consolidate it. Thus, membrane 20 communicates with pressurized chamber 112 and main roller 60 to simultaneously effect both a predetermined fluid flow through and a mechanical pressing force on continuous web 140, in combination, to promote enhanced de-watering of continuous web 140.

The invention is particularly advantageous when the dry content of continuous web 140 prior to de-watering is higher than about 6 percent and lower than about 70 percent, and when the basis weight of continuous web 140 is higher than about 25 g/m$^2$.

Web carrying layer 142 preferably has a thickness of about 0.1 inches or less, and may be a felt, or alternatively, may include a felt positioned adjacent a hydrophobic layer, wherein the hydrophobic layer is positioned adjacent second side 146 of continuous web 140. Preferably, web carrying layer 142 includes a felt layer 142A integral with a hydrophobic layer 142B, wherein hydrophobic layer 142B transports water via capillary action away from continuous web 140 to be received by felt layer 142A (see FIG. 6). The hydrophobic layer 142B provides an anti-rewetting effect, thereby avoiding water flowing back into continuous web 140.

The relative amounts of mechanical pressure applied to continuous web 140 is effected by factors such as the chamber pressure in chamber 112, the permeability of semipermeable membrane 20, and the permeability of continuous web 140. The fluid flow, preferably air, through continuous web 140 is effected by factors such as the chamber pressure in chamber 112, the permeability of semipermeable membrane 20, and the size (e.g., length) of chamber 112. The dynamic fluid pressure in pressurized chamber 112 is controlled based upon the monitoring of the chamber pressure by sensor assembly 126. Sensor assembly 126 senses a pressure within chamber 112 and provides a pressure feedback signal to controller 120. Controller 120 processes the pressure feedback signal to generate a pressure output signal which is supplied to fluid source 124 to selectively control the fluid output thereof to control a pressure of pressurized chamber 112 to a predetermined pressure, preferably to a pressure greater than 30 p.s.i. above the pressure of differential pressure source 125. If a temperature in relation to pressure within pressurized chamber 112 is of concern, sensor assembly 126 may be adapted to sense a temperature within chamber 112 and provide a temperature feedback signal to controller 120. Controller 120 processes the temperature feedback signal, along with the pressure feedback signal, to generate output signals which are supplied to fluid source 124 to regulate the pressure and temperature in pressurized chamber 112.

Controller 120 also controls the loading of main rollers 60, 62 by cap rollers 64, 66 by controlling an amount of pressure that loading cylinder 14 applies to upper and lower pivot arms 28, 30. Preferably, the amount loading of main rollers 60, 62 is related to a pressure in pressurized chamber 112, which is monitored by a pressure sensor of sensor assembly 126. The loading may include a bias loading in addition to a loading proportional to the pressure in chamber 112.

Figure 4:
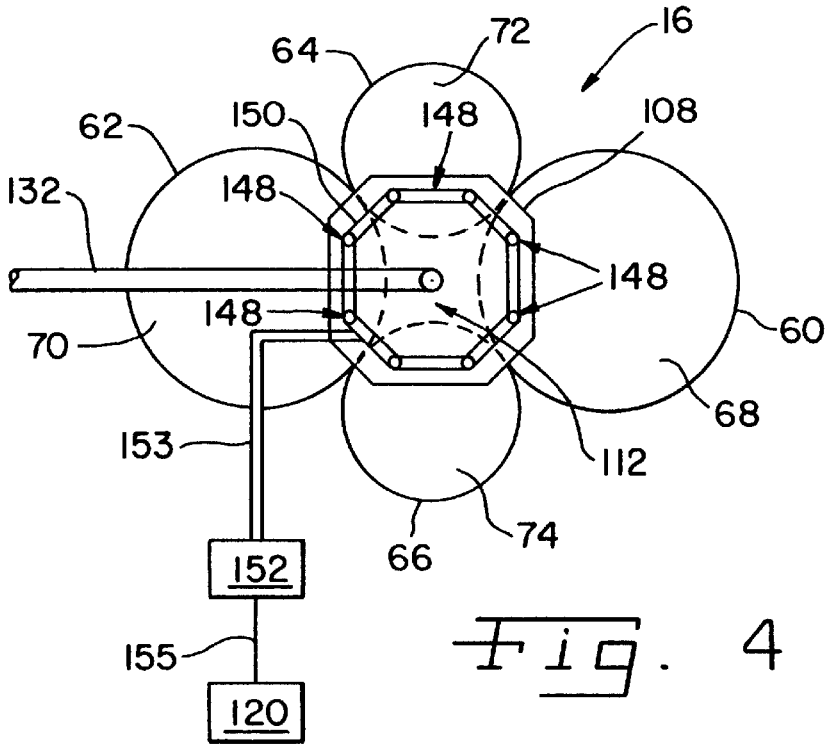
FIG. 4 is a schematic illustration of a variant of an end sealing panel of the present invention.

Of course, variations of the embodiment described above are possible. For example, and referring to FIG. 4, to maintain the end sealing of chamber 112, and to prevent wear between sealing panels 108, 110 and rollers 60, 62, 64 and 66, a lubricating and sealing fluid like air or water, or some viscous fluid, can be forced into a plurality of seal ports 148 via a conduit ring 150 coupled to a fluid source 152 via conduit 153. Pressurized fluid source 152 is electrically coupled to controller 120 via electrical cable 155, and is controlled thereby. Seal ports 148 in sealing panels 108, 110 are located to face the ends of the rollers 60, 62, 64, 66 to pass the pressurized lubricating and sealing fluid between sealing panels 108, 110 and portions of the respective circular ends 68, 70, 72, 74 and 76, 78, 80, 82. Thus, due to the injection of the lubricating and sealing fluid, sealing panels 108, 110 float over the circular ends 68, 70, 72, 74 and 76, 78, 80, 82 at small controllable distances, with little or no physical contact between sealing panels 108, 110 and the circular ends 68, 70, 72, 74 and 76, 78, 80, 82 of rollers 60, 62, 64, 66. Although there is leakage around such a seal arrangement, the amount of leakage is controllable to be small by careful selection of distance tolerances and the lubricating and sealing fluid.

Figure 5:
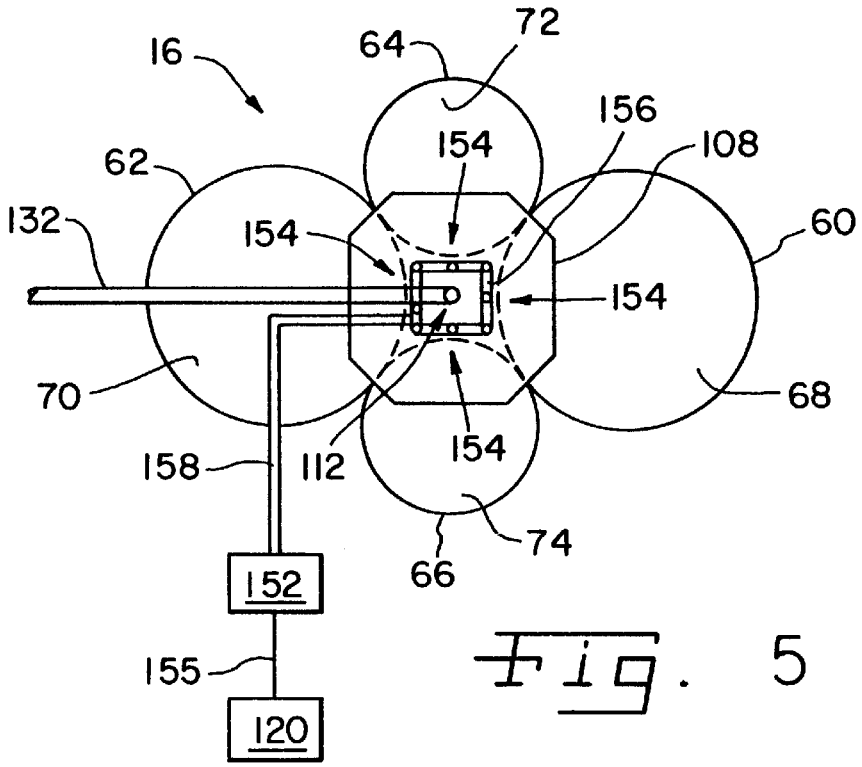
FIG. 5 is a schematic illustration of a variant of another end sealing panel of the present invention.

FIG. 5 shows another variant of the invention, in which end sealing of chamber 112 is improved by locating fluid ports 154 in sealing panels 108, 110 to be near, but not located to face, the ends of the rollers 60, 62, 64, 66. A conduit ring 156 is coupled to ports 154, and is coupled to fluid source 152 via conduit 158, to supply a lubricating and sealing fluid, such as air or water, or some other viscous fluid, into chamber 112 through ports 154. Fluid source 152 is electrically coupled to controller 120 via electrical cable 155, and is controlled thereby. Pressure in chamber 112 forces the added fluid between circular ends 68, 70, 72, 74 and 76, 78, 80, 82 of rollers 60, 62, 64, 66 and sealing panels 108, 110, respectively, allowing sealing panels 108, 110 to float over the circular ends. In this embodiment, leakage is controlled by controlling the spacing between circular ends 68, 70, 72, 74 and 76, 78, 80, 82 of rollers 60, 62, 64, 66 and sealing panels 108, 110, respectively, so that excessive leakage doesn't occur in one area, and so as to prevent excessive wear between the sealing panels 108, 110 and rollers 60, 62, 64, 66.

Figure 6:
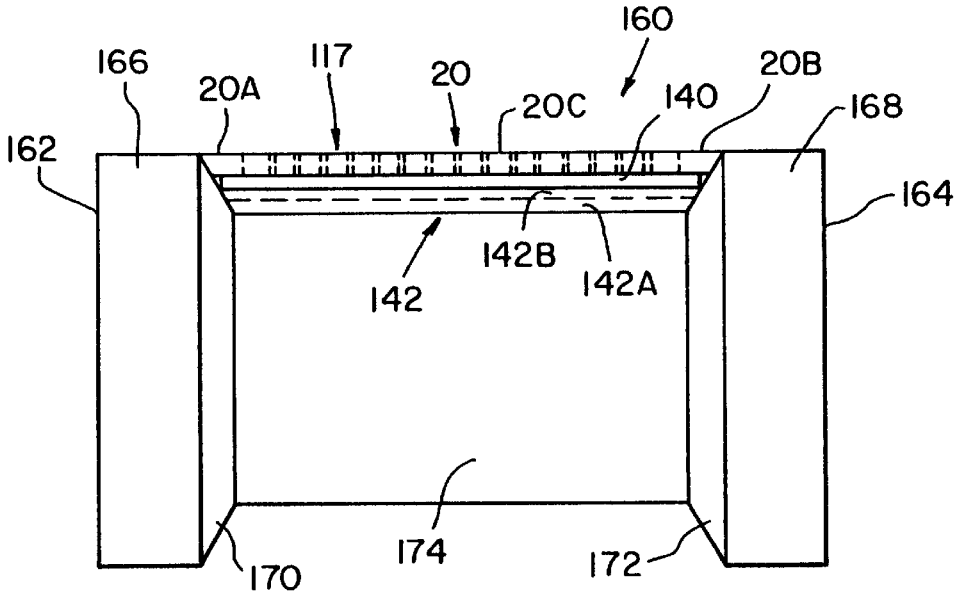
FIG. 6 is an exaggerated side view of a variant of a main roller profile of the invention.

FIG. 6 shows another variant of the invention, in which a main roller 160 having the profile shown would replace main roller 60. Main roller 160 includes a first circular end 162, a second circular end 164, a first cylindrical end surface 166 and a second cylindrical end surface 168, a first inclined annular surface 170, a second inclined annular surface 172 and a cylindrical middle surface 174. First cylindrical end surface 166 is located adjacent first circular end 162 and second cylindrical end surface 168 is located adjacent second circular end 164. Cylindrical middle surface 174 has a circumference smaller than a circumference of first and second cylindrical end surfaces 166, 168. First inclined annular surface 170 provides a transition from cylindrical middle surface 174 to first cylindrical end surface 166, and second inclined annular surface 172 provides a transition from cylindrical middle surface 174 to second cylindrical end surface 168.

A width of cylindrical middle surface 174 is selected to be approximately equal to a width of membrane 20. First and second inclined annular surfaces 170, 172 define a guide path for membrane 20, continuous web 140 and web carrying layer 142. Preferably, each of membrane 20, and web carrying layer 142 includes a pair of tapered outer edges which contact the first and second inclined annular surfaces 170, 172. Most preferably, permeable membrane 20 includes a pair of tapered impermeable longitudinal outer edges 20A, 20B formed adjacent a semipermeable portion 20C to enhance sealing along inclined annular surfaces 170, 172. Also, preferably, web carrying layer 142 includes felt layer 142A and hydrophobic layer 142B. Optionally, web carrying layer 142 may include a pair of impermeable longitudinal outer edges which contact first and second inclined annular surfaces 170, 172.

Figure 7:
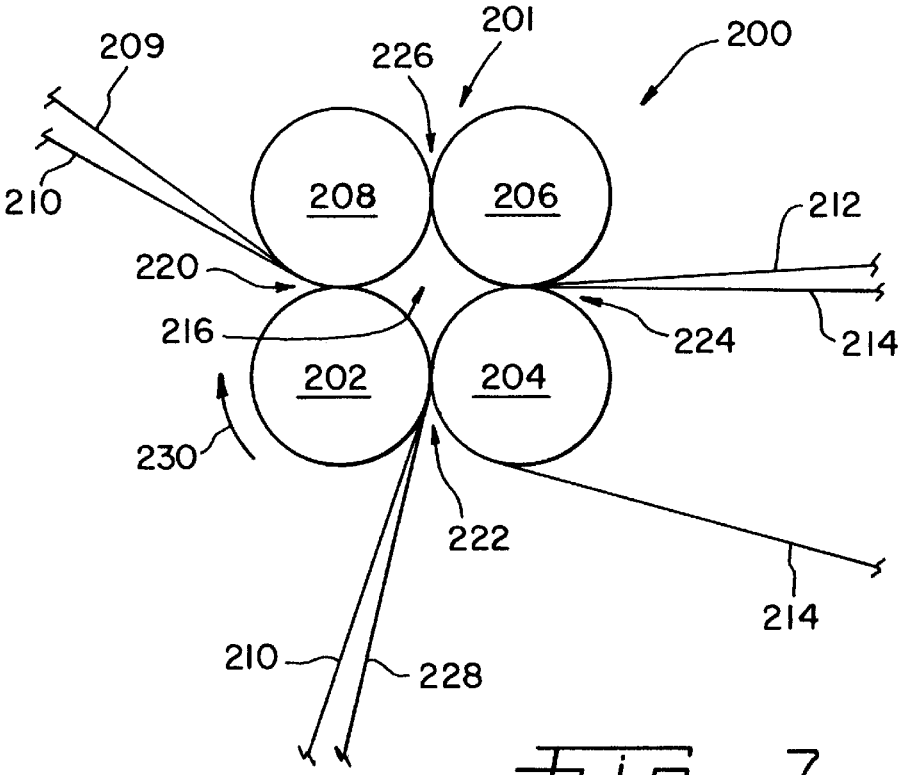
FIG. 7 is a schematic illustration of a variant of the single chamber embodiment of FIG. 1.

FIG. 7 schematically illustrates another variant of the invention, in which a press arrangement 200 includes a roller assembly 201 including a plurality of rollers 202, 204, 206, 208 arranged in a square pattern for cooperative rotation in processing a first continuous web 209, such as a paper web, riding on a web carrying layer 210 and a second continuous web 212, such as a paper web, riding on a web carrying layer 214. Web carrying layers 210, 214 may be, for example, felt layers.

Each of the rollers 202, 204 are of the type previously described above as main roller 60, and each of the rollers 206, 208 are of the type described above as cap rollers 64, 66, and thus, will not be described again in detail. Also, it is to be understood that sealing panels of the same general type as described above with respect to sealing panels 108 and 110 would be utilized in the manner described above with respect to FIGS. 4 and 5 to define a chamber 216. Control and pressure source connections to chamber 216, and associated operation, are as described above with respect to FIGS. 1–4, and thus will not be repeated here.

For purposes of this discussion, rollers 202 and 204 will be referred to as main rollers, and rollers 206, 208 will be referred to as cap rollers, although in the present embodiment, rollers 202, 204, 206, 208 are of approximately the same size. Main rollers 202, 204 and cap rollers 206, 208 are positioned to define a plurality roller nips 220, 222, 224, 226 of which based upon a rotation of main roller 202 in the direction depicted by arrow 230, roller nips 220, 224 constitute inlet roller nips of press arrangement 200, and roller nips 222, 226 constitute outlet roller nips.

First continuous web 209 and first web carrying layer 210 enter input nip 220 and are processed through chamber 216 around the circumference of main roller 202. Second continuous web 212 and second web carrying layer 214 enter inlet nip 224 and are processed through chamber 216 around the circumferential surface of main roller 204. First web carrying layer 210, continuous web 209, continuous web 212 and second web carrying layer 214 are processed through outlet nip 222 to form a laminated web 228 made up of continuous webs 209, 212. During processing, second continuous web 212 remains in contact with first continuous web 209 due to surface tension, or due to venting in main roller 202 by holes, grooves or pores formed in the cylindrical surface of main roller 202. It is contemplated that second continuous web 212 and second web carrying layer 214 could be replaced by a coating layer which would be applied to continuous web 209.

Figure 8:
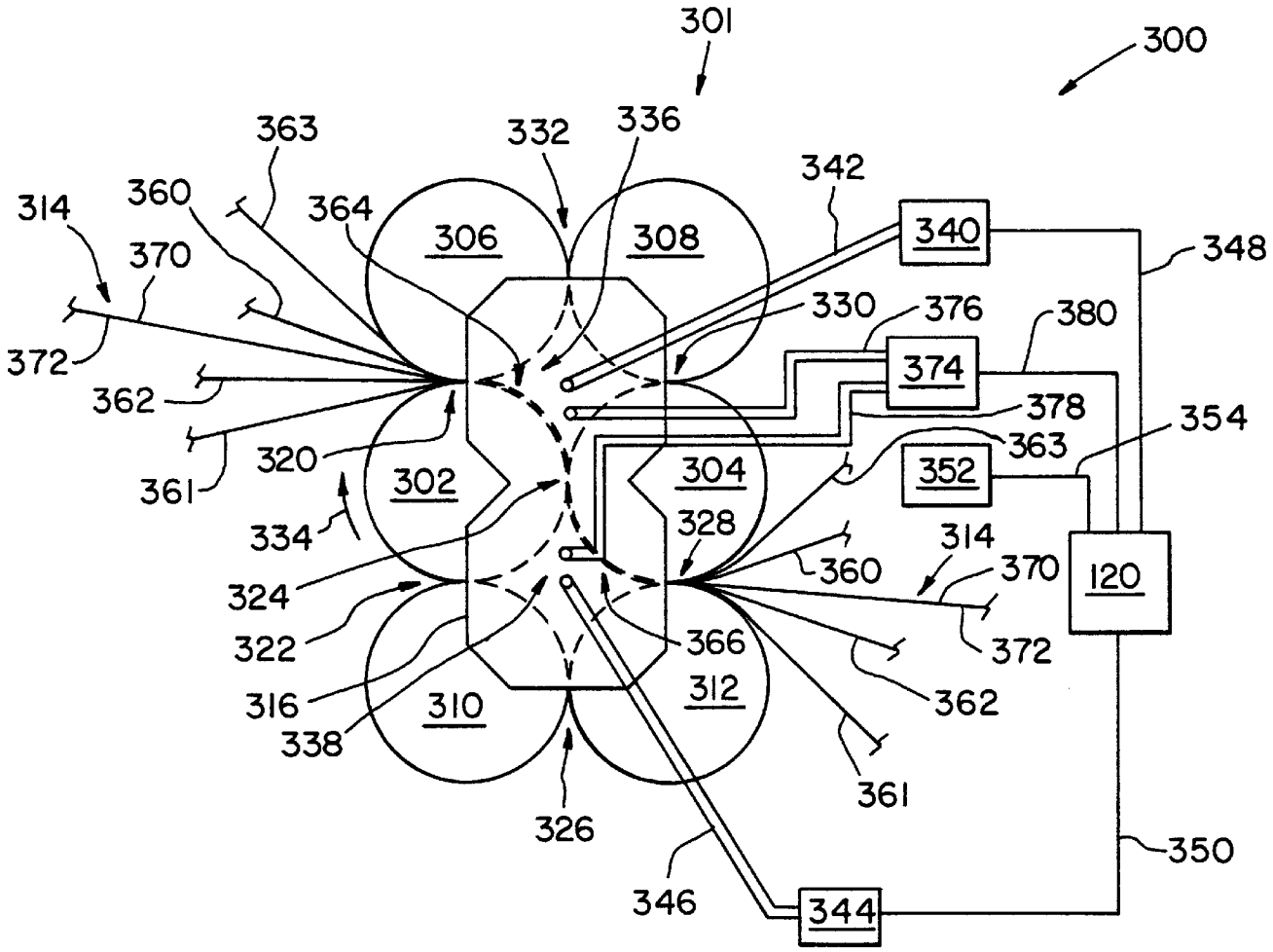
FIG. 8 is a schematic illustration of an embodiment of the invention including two chambers.

FIG. 8 is a schematic illustration of another embodiment of the invention in which a press arrangement 300 includes a roller assembly 301 including a plurality of rollers 302, 304, 306, 308, 310 and 312 arranged for cooperative rotation in processing a continuous web 314, such as a paper web. Each of the rollers 302, 304 are of the type previously described as main roller 60 and/or 160, and are fluidly coupled to a differential pressure source in a manner as described above. Rollers 306, 308, 310, 312 are of the type described above with respect to non-vented main and cap rollers, such as main roller 62 and cap roller 64, and thus, will not be described again in detail. Also, sealing panel 316 is of the same general type as described above with respect to sealing panels 108 and 110, and can be utilized in the manner described above with respect to FIGS. 4 and 5.

For purposes of this discussion, rollers 302 and 304 will be referred to as main rollers, and rollers 306, 308, 310 and 312 will be referred to as cap rollers based upon their respective primary function within a given chamber with respect to continuous web 314. In the present embodiment, rollers 302, 304, 306, 308, 310 and 312 are of approximately the same size. Main rollers 302, 304 and cap rollers 306, 308, 310, 312 are positioned to define a plurality of roller nips 320, 322, 324, 326, 328, 330, 332, of which based upon a rotation of main roller 302 in the direction depicted by arrow 334, roller nips 320, 326, 330 constitute inlet roller nips of press arrangement 300, roller nips 322, 328, 332 constitute outlet roller nips, and roller nip 324 is a chamber dividing nip. The orientation and/or size of rollers 302, 304, 306, 308, 310 and 312 may be modified to locate the roller nips at the desired locations and to optimize the efficiency of processing.

Sealing panels 316, together with rollers 302, 304, 306, 308, 310 and 312 define a first chamber 336 and a second chamber 338, wherein each chamber has associated therewith at least one inlet nip and at least one outlet nip.

A first pressure source 340 is fluidly coupled to chamber 336 via conduit 342, and a second pressure source 344 is fluidly coupled to chamber 338 via conduit 346. Conduits 342 and 346 extend from sealing panel 316 into chambers 336 and 338, respectively, to distribute a fluid flow therein. Controller 120 is electrically coupled to pressure source 340 via an electrical cable 348 and is electrically coupled to pressure source 344 via an electrical cable 350. A sensor assembly 352 is electrically connected to controller 120 via electrical cable 354. Sensor assembly 352 is adapted to monitor the pressure and temperature of each of chambers 336, 338.

Press arrangement 300 further includes a first semipermeable membrane 360 and a second semipermeable membrane 362. Membranes 360, 362 interact with the circumferential surfaces of main rollers 302, 304 to define a first expanded nip 364 and a second expanded nip 366. Expanded nip 364 is located in first chamber 336 and expanded nip 366 is located in second chamber 338.

Continuous web 314 includes a first side 370 and a second side 372. While in chamber 336, a fluid flows through continuous web 314 in a first direction from first side 370 to second side 372 at expanded nip 364. While in chamber 338, a fluid flows through continuous web 314 in a second direction, opposite from the first direction, from second side 372 to first side 370 at expanded nip 364. First membrane 360 communicates with first chamber 336 and main roller 302 to apply a mechanical pressing force to continuous web 314 in the first direction, i.e., from first side 370 to second side 372. Second membrane 362 communicates with second chamber 338 and main roller 304 to apply a mechanical pressing force to continuous web 314 in the second direction, i.e. from second side 372 to first side 370. Thus, membranes 360, 362 communicate with pressurized chambers 336, 338, respectively, and main rollers 302, 304, respectively, to simultaneously effect both a predetermined fluid flow and a mechanical pressing force on continuous web 314, in combination, in two directions, to promote enhanced de-watering of continuous web 314. In the present embodiment, main rollers 302, 304 each include at least one void, such as a hole, groove or pore, to effect a pressure differential across continuous web 314.

Preferably, each of first semipermeable membrane 360 and second semipermeable membrane 362 is made of a rubberized fabric about 0.1 inches thick, or less, and is made semipermeable by forming a plurality of holes through the fabric having a size, shape, frequency and/or pattern selected to provide the desired permeability. Preferably, the plurality of holes are formed by a laser. The permeability of each of first semipermeable membrane 360 and second semipermeable membrane 362 is selected to be greater than zero and less than about five CFM per square foot as measured by TAPPI test method TIP 0404-20, and more preferably, to be greater than zero and less than about two CFM per square foot.

In preferred embodiments, press arrangement 300 further includes a first web support layer 361 and a second web support layer 363 positioned, respectively, on opposing sides of continuous web 314. As shown in FIG. 8, first web support layer 361 is positioned between membrane 362 and rollers 302 and 312, and second web support layer 363 is positioned between membrane 360 and rollers 306 and 304. Alternatively, first web support layer 361 can be positioned to lie between continuous web 314 and membrane 362 and second web support layer 363 can be positioned to lie between continuous web 314 and membrane 360. Preferably, each of web support layers 361, 363 is an integral fabric having a felt layer and a hydrophobic layer with a total thickness of about 0.1 inches or less, and is oriented such that the hydrophobic layer faces continuous web 314.

As shown in FIG. 8, expanded nips 364 and 366 are substantially the same length. However, the nip lengths may be of different lengths, which can be effected, for example, by selecting main rollers with differing circumferences, and/or by changing the circumferential size of any one or more of the cap rollers, to effectively change the location of one or more of the roller nips 320, 324 and 328.

The internal pressure of each of first chamber 336 and second chamber 338 are individually controlled by controller 120, and may be pressurized to different pressures. Preferably, chamber 338 is pressurized to a greater pressure than the pressure of chamber 336. Also, in some instances it may be desirable to charge chamber 336 with a first material and charge chamber 338 with a second material different than the first material. Such materials may include dry air, steam, other gas, water, or other fluid.

In addition to controlling the pressures in chambers 336, in some instances it is desirable to control the temperatures of chambers 336, 338 to the same, or possibly different, temperatures. FIG. 8 further shows a temperature regulation unit 374 fluidly coupled via conduits 376, 378 to chambers 336, 338, respectively, to supply a heating or cooling fluid, such as air, to chambers 336, 338. Temperature regulation unit 374 is electrically coupled to controller 120 via electrical cable 380. Controller 120 receives temperature signals representing the temperatures of chambers 336, 338 from sensor assembly 352. Controller 120 then uses these temperatures to generate temperature output signals based upon predefined target temperatures, which are supplied to temperature regulation unit 374. Temperature regulation unit 374 then responds to the temperature output signals to regulate the temperatures of chambers 336, 338. Preferably, the temperature of chamber 338 is controlled to be greater than the temperature of chamber 336.

Alternatively, the temperature regulation of chambers 336, 338 can be effected by regulating the temperature of the fluids supplied by first pressure source 340 and/or second fluid source 344 to chambers 336, 338, respectively. In such a case, temperature regulation unit 374 can be eliminated.

Figure 9:
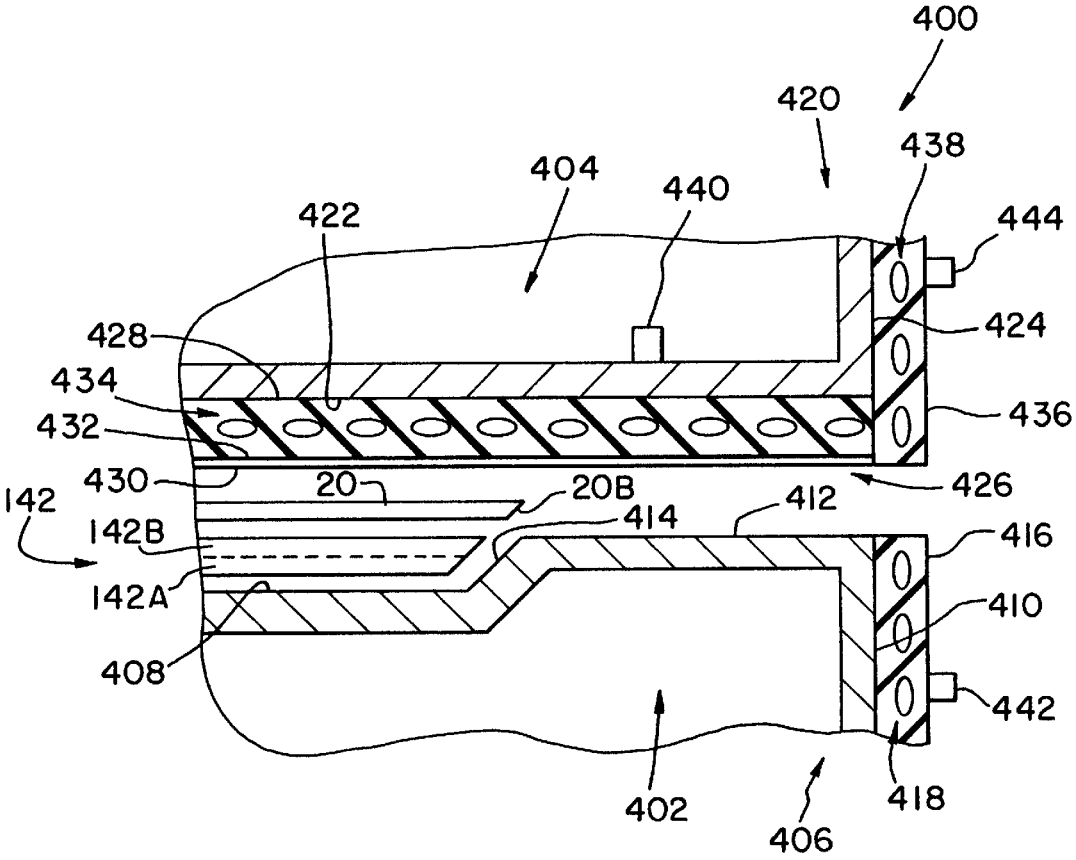
FIG. 9 is an exploded partial sectional view illustrating chamber sealing aspects of the present invention.

FIG. 9 shows a portion of a roller arrangement 400 including main roller 402 and a cap roller 404 which can be used in the place of previously described main rollers and cap rollers, respectively.

Main roller 402 includes a general structure corresponding to that of main roller 160 shown in FIG. 6. While only a right end portion 406 of main roller 402 is depicted in FIG. 9, it is to be understood that the left end of roller 402 is a mirror image of right end 406, and thus, the same reference numbers used to describe right end 406 will apply to the left end of main roller 402.

Main roller 402 includes a cylindrical middle surface 408, left and right circular ends 410, left and right cylindrical end surfaces 412 and left and right inclined annular surfaces 414. Cylindrical end surfaces 412 are located adjacent respective circular ends 410. Cylindrical middle surface 408 has a circumference smaller than a circumference of cylindrical end surfaces 412. Inclined annular surfaces 414 provide a transition from cylindrical middle surface 408 to cylindrical end surfaces 412. Cylindrical middle surface 408 includes at least one void, such as a groove, hole or pore, to facilitate a pressure differential across membrane 20 and any intervening material.

A spacing between inclined annular surfaces 414 of main roller 402 is selected to be approximately equal to a width of semipermeable membrane 20. Inclined annular surfaces 414 define a guide path for semipermeable membrane 20 and web carrying layer 142. Preferably, each of semipermeable membrane 20, and web carrying layer 142 includes a pair of tapered outer edges which contact inclined annular surfaces 414. Most preferably, semipermeable membrane 20 includes a pair of tapered impermeable longitudinal outer edges 20A, 20B (see FIG. 6) to enhance sealing along inclined annular surfaces 414. Web carrying layer 142 includes felt layer 142A and hydrophobic layer 142B. The profiles of semipermeable membrane 20 and web carrying layer 142 are preferably sized to fit into the roller profile of main roller 402 between inclined annular surfaces 414 such that membrane 20 and cylindrical end surfaces 412 are substantially at the same circumferential height. In operation, a continuous web, such as a paper web, (not shown) would be interposed between semipermeable membrane 20 and web carrying layer 142.

Attached to circular ends 410 are replaceable end seals 416 which include a plurality of fluid cavities 418. Attachment is effected by adhesive, or by fasteners. Replaceable end seals 416 are preferably made of an elastic material, such as rubber, and may include a reinforcement fabric, such as nylon or steel.

Cap roller 404 includes a generally cylindrical structure corresponding to that of cap roller 64 shown in FIGS. 1–3. While only a right end portion 420 of cap roller 404 is depicted in FIG. 9, it is to be understood that the left end of cap roller 404 is a mirror image of right end 420, and thus, the same reference numbers used to describe right end 420 will apply to the left end of cap roller 404.

Cap roller 404 includes a cylindrical middle surface 422, and left and right circular ends 424. A sealing sleeve 426 having an inner surface 428 and an outer surface 430 is received over cylindrical middle surface 422, and is held in fixed relation with cap roller 404 due to frictional forces acting between cylindrical middle surface 422 and inner surface 428 of sealing sleeve 426. Alternatively, sealing sleeve 426 can be held in place in by adhesive, or by fasteners located below outer surface 430 of sealing sleeve 426 and received into cylindrical middle surface 422.

Preferably, however, sealing sleeve 426 is replaceable such that when sealing sleeve 426 exhibits and unacceptable amount of wear, sealing sleeve 426 can be replaced without the need to discard cap roller 404. Sealing sleeve 426 includes a stress layer 432 and a plurality of fluid cavities 434.

Attached to circular ends 424 are replaceable end seals 436 which include a plurality of fluid cavities 438. Attachment is effected by by adhesive, or by fasteners. Replaceable end seals 436 are preferably made of an elastic material, such as rubber, and may include a reinforcement fabric, such as nylon or steel.

Sealing sleeve 426 is preferably made of an elastic material, such as rubber. Stress layer 432 of sealing sleeve 426 is used to contain the hoop stresses and/or cross-machine stresses of sealing sleeve 426, and includes a reinforcement fabric, such as nylon or steel. The size, shape, and geometry of fluid cavities 434 are selected to be elastically deformable, particularly near longitudinal edges 20A, 20B (see FIG. 6) of semipermeable membrane 20. Also, preferably, fluid cavities 434 either extend circumferentially around sealing sleeve 426 in a repeating pattern across the width of cap roller 404, or extend across the width of cap roller 404 in a repeating pattern around the circumference of sealing sleeve 426. Alternatively, cavities 434 can extend diagonally around sealing sleeve 426.

Fluid cavities 434 are pressurized with a fluid, such as air, water or gel, to maintain a pliable, yet positive seal, with semipermeable membrane 20 and cylindrical end surfaces 412 of main roller 402. In one form of the invention, fluid cavities 434 are pressurized at the time of manufacture of sealing sleeve 426. Alternatively, pneumatic cavities 434 are not pre-pressurized at the time of manufacture of sealing sleeve 426, but rather, sealing sleeve 426 may include one or more valve port(s) 440, such as the type commonly used to insert air in a pneumatic tire, for receiving fluid to pressurize cavities 434. Alternatively, valve port(s) 440 may be open ports connected to a fluid source via a fluid conduit and a rotary fluid coupling. In some applications, it may be desired to interconnect the fluid cavities 434 so as to distribute any applied external forces, and to effectively form a single cavity.

Fluid cavities 418, 438 of replaceable end seals 416, 436 are pressurized with a fluid, such as air, water or gel. The size, shape, and geometry of cavities 418, 438 are selected to be elastically deformable, to maintain a pliable, yet positive seal, between replaceable end seals 416, 436 and with the associated sealing panels, such as sealing panels 108, 110 of FIG. 3. In one form of the invention, fluid cavities 418, 438 are pressurized at the time of manufacture of end seals 416, 436. Alternatively, fluid cavities 418, 438 are not pre-pressurized at the time of manufacture of end seals 416, 436. Rather, replaceable end seals 416, 436 may each include one or more valve port(s) 442, 444, respectively, such as the type commonly used to insert air in a pneumatic tire, for receiving fluid to pressurize cavities 418, 438. In some applications, it may be desired to interconnect the fluid cavities 418 or interconnect the fluid cavities 438. Interconnecting the cavities effectively forms a singe cavity so as to distribute any applied external forces within the formed single cavity.

Figure 11:
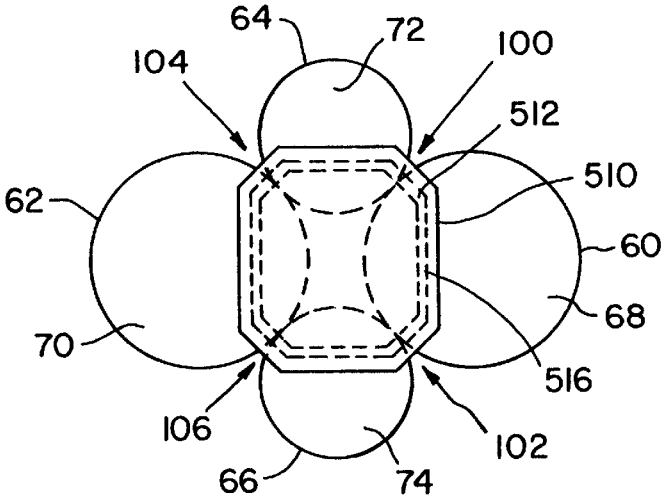
FIG. 11 is a schematic side illustration of a end sealing panel of the invention.
Figure 10:
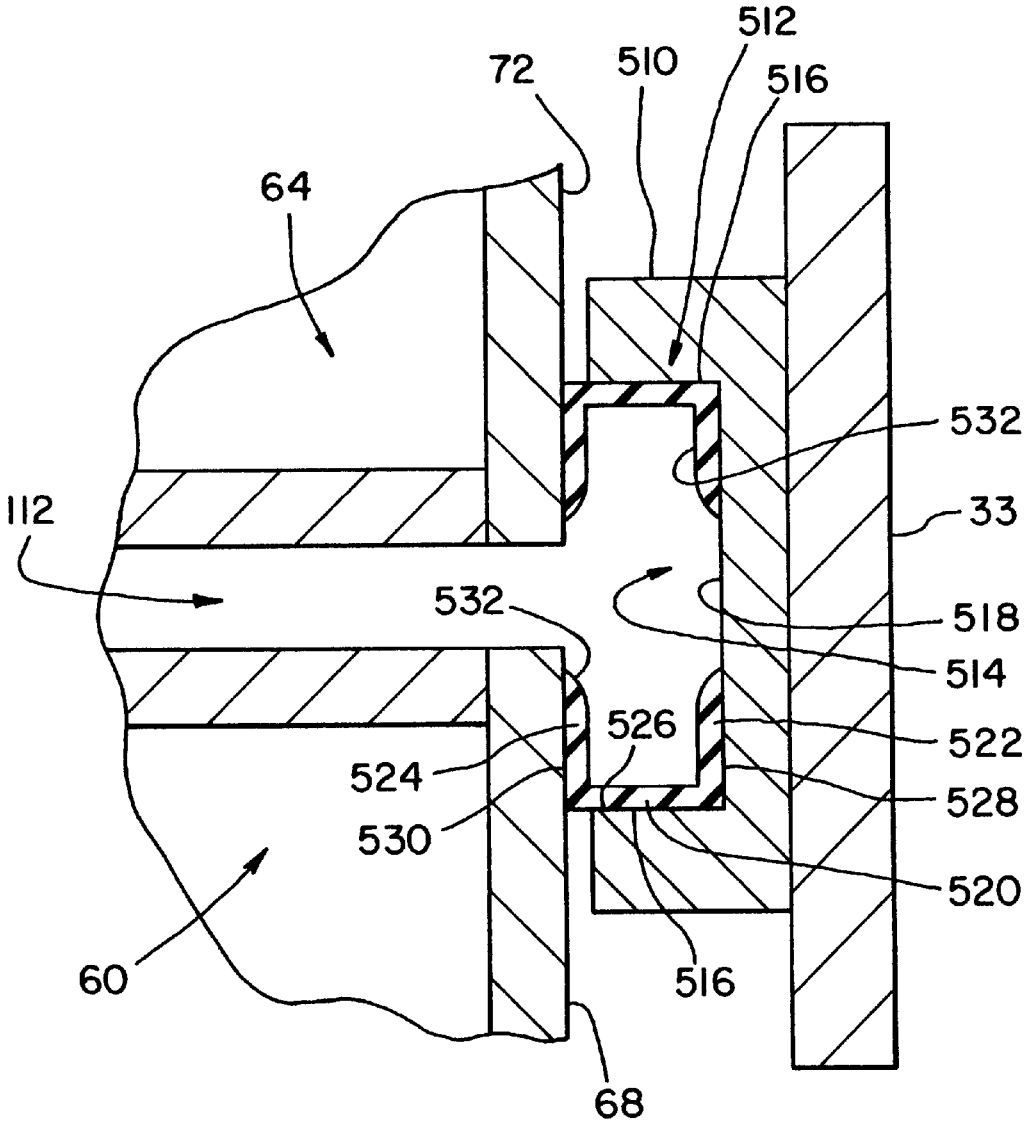
FIG. 10 is a fragmentary detail view illustrating a sealing aspect of the present invention.

FIGS. 10 and 11 illustrate of the roller configuration of FIGS. 1 and 3–5, wherein sealing panel 110 of FIG. 3 is replaced with a sealing panel 510. Sealing panel 510 houses a unitary seal 512 having a U-shaped cross-section. As shown in FIG. 11, sealing panel 512 is sized to provide sealing along circular ends 68, 70, 72, 74 of rollers 60, 62, 64, 66, respectively, and preferably pass from one roll to the adjacent roll at the corresponding roller nip 100, 102, 104, 106. While only a right end sealing panel 510 housing unitary seal 512 is depicted in FIGS. 10 and 11, it is to be understood that a left end panel for replacing end panel 108 of FIG. 1 is a mirror image of sealing panel 510, and thus, the reference numbers and associated discussion used to describe right sealing panel 510 will apply to the left sealing panel as well, and that any discussion of unitary seal 512 equally applies to left and right sealing panels.

Referring to FIG. 10, sealing panel 510 includes an end cavity 514 defining an inner perimetrical surface 516 extending outwardly from an inner end surface 518. The shape and size of inner perimetrical surface 516 is selected to position unitary seal 512 to contact circular ends 68, 70, 72, 74 of rollers 60, 62, 64, 66, respectively, to pass from one roll to the adjacent roll at a location where the adjacent rollers are in contact, which substantially corresponds to roller nips 100, 102, 104, 106. Also, preferably, the selected shape limits the area of the end plate which is subjected to chamber pressure forces.

As shown in FIG. 10, unitary seal 512 has a substantially U-shaped cross-section and includes a base portion 520 which defines a closed portion of unitary seal 512. Unitary seal 512 further includes first and second sidewalls 522, 524 which extend outwardly from base 520. The base portion 520 includes a base surface 526 for contacting inner perimetrical surface 516 of sealing panel 510. First side wall 522 includes a first wall surface 528 which is positioned to contact inner end surface 518 of sealing panel 510. Second side wall 524 includes a wall surface 530 which is positioned to contact a portion of circular ends 68, 70, 72, 74 of rollers 60, 62, 64, 66.

Base portion 520, first sidewall 522 and second sidewall 524 together define a cup-shaped interior surface 532.

Unitary seal 512 is made of a flexible elastic material which is abrasion resistant. The sidewalls 522, 524 act as defectable flaps when interior surface 532 is exposed to the pressure forces of chamber 112. Thus, sealing forces exerted by base surface 526, first wall surface 528 and second wall surface 530 of unitary seal 512 on inner perimetrical surface 516 and inner end surface 518 of sealing panel 510 and on circular ends 68, 70, 72, 74 of rollers 60, 62, 64, 66 is dependent upon the amount of pressure in chamber 112. Accordingly, as the pressure in chamber 112 increases, the sealing forces exerted by unitary seal 512 increase in response.

Sealing panel 510 can be combined with the lubricating and sealing systems described above with respect to FIGS. 4 and 5 to provide a lubricating and sealing fluid like water, or some viscous fluid, to further enhance the end sealing of chamber 112, and to reduce the wear between unitary seal 512 and the contact surfaces of sealing panel 510 and rollers 60, 62, 64 and 66. For example, pressurized fluid source 152 can provide the lubricating and sealing fluid at a location at the interior of unitary seal 512 via seal ports 148 or 154, as more fully described above with respect to FIGS. 4 and 5.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for processing a continuous web, comprising:

a plurality of rollers arranged for cooperative rotation, each of said plurality of rollers having a first circular end surface, a second circular end surface and a cylindrical middle surface, said plurality of rollers defining a corresponding plurality of nips; and first and second sealing panels for engaging said first and second circular ends of each of said plurality of rollers, said first and second sealing panels and said plurality of rollers defining a chamber, said first and second sealing panels being structured and adapted to conform generally to the shape of said first and second circular end surfaces, respectively, of said plurality of rollers.

2. The apparatus of claim 1, further comprising a first seal positioned between said first circular end of each of said plurality of rollers and said first sealing panel, and a second seal positioned between said second circular end of each of said plurality of rollers and said second sealing panel.

3. The apparatus of claim 2, wherein each of the first and second seals form mechanical seals.

4. The apparatus of claim 3, wherein each of said first and second seals include pressurized fluid cavities.

5. The apparatus of claim 3 wherein said first seal is mounted on the first circular end of each of said plurality of rollers and wherein said second seal is mounted on the second circular end of each of said plurality of rollers.

6. The apparatus of claim 2, wherein each of the first and second seals form fluid seals.

7. The apparatus of claim 6, wherein each of said first and second sealing panels include an inlet port for receiving a pressurized flow of a sealing fluid to form said fluid seals.

8. The apparatus of claim 7, wherein said sealing fluid is a viscous fluid.

9. The apparatus of claim 1, further comprising at least one tension bar having a first end and a second end, said first end being connected to said first sealing panel and said second end being connected to said second sealing panel.

10. An apparatus for processing a continuous web, comprising:

a plurality of rollers arranged for cooperative rotation, each of said plurality of rollers having a first circular end surface, a second circular end surface and a cylindrical middle surface, said plurality of rollers defining a corresponding plurality of nips;

a first sealing panel and a second sealing panel for engaging said first and second circular ends of each of said plurality of rollers, the first and second sealing panels and said plurality of rollers defining a chamber; and a fluid seal formed between at least one of said first circular end of each of said plurality of rollers and said first sealing panel, and said second circular end of each of said plurality of rollers and said second sealing panel.

11. The apparatus of claim 10, further comprising:

a fluid source;

a plurality of sealing ports coupled to said fluid source, said plurality of sealing ports being formed in at least one of said first sealing panel and said second sealing panel; and a controller for controlling said fluid source to supply a flow of sealing fluid to said plurality of sealing ports to form said fluid seal.

12. The apparatus of claim 11, wherein said plurality of sealing ports are located to face at least one of said first circular end surface and said second circular end surface of each of said plurality of rollers to eject said sealing fluid between said at least one of said first circular end of each of said plurality of rollers and said first sealing panel, and said second circular end of each of said plurality of rollers and said second sealing panel.

13. The apparatus of claim 12, wherein said sealing fluid is a viscous fluid.

14. The apparatus of claim 12, wherein said sealing fluid is one of air and water.

15. The apparatus of claim 11, wherein said plurality of sealing ports are located to face into said chamber near at least one of said first circular end surface and said second circular end surface of said plurality of rollers to supply said sealing fluid into said chamber.

16. The apparatus of claim 15, further comprising a pressure source for pressurizing said chamber to a pressure, wherein said pressure forces said sealing fluid between said at least one of said first circular end of each of said plurality of rollers and said first sealing panel, and said second circular end of each of said plurality of rollers and said second sealing panel.

17. An apparatus for processing a continuous web, comprising:

a plurality of rollers arranged for cooperative rotation, each of said plurality of rollers having a first circular end surface, a second circular end surface and a cylindrical middle surface, said plurality of rollers defining a corresponding plurality of nips;

first and second sealing panels for engaging said first and second circular ends of each of said plurality of rollers, said first and second sealing panels and said plurality of rollers defining a chamber, and at least one of said first and second sealing panels including an end cavity defining an inner perimetrical surface extending outwardly from an inner end surface; and at least one unitary seal including a base, a first side wall and a second side wall, and having a substantially U-shaped cross-section, said base of said at least one unitary seal contacting said inner perimetrical surface of said cavity said base defining a closed portion of said substantially U-shaped cross-section, said first side wall of said at least one unitary seal contacting said inner end surface of said cavity, and said second side wall of said at least one unitary seal contacting at least a portion of one of said first circular end surface of each of said plurality of rollers and said second circular end surface of each of said plurality of rollers.

18. The apparatus of claim 17, further comprising a pressure source for pressurizing said chamber, wherein as a pressure increases in said chamber, a sealing force exerted by said base surface, said first wall and said second wall of said at least one unitary seal increases.

19. The apparatus of claim 17, wherein said at least one unitary seal is positioned to extend along one of said first circular end surface and said second circular end surface of said plurality of rollers substantially to each of said corresponding plurality of nips.

20. The apparatus of claim 17, further comprising a lubrication unit coupled to at least one of said first and second sealing panels to supply a lubricating fluid to said at least one unitary seal.

21. The apparatus of claim 20, wherein said lubricant comprises a viscous fluid.

22. The apparatus of claim 20, wherein said lubricant comprises water.

23. The apparatus of claim 17, wherein said at least one unitary seal is made of an elastic material.

* * * * *

UNITED STATES PATENT AND TRADEMARK OFFICE

CERTIFICATE OF CORRECTION

PATENT NO. : 6,161,303

DATED December 19, 2000

INVENTOR(S) : David A. Beck

It is certified that error appears in the above-identified patent and that said Letters Patent is hereby corrected as shown below:

Column 1

Line 1, delete "claim" and substitute "Claims" therefor.
Line 2, after Oct. 29, 1998 insert --,-- and delete "which this application claim benifit" therefor.
Line 3, after Nov. 2, 1998 insert --,-- and --and-- then delete "which this application claim benifit" therefor.

Column 6

Line 3, delete "healed" and substitute --heated-- therefor.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*